US006302182B1

(12) United States Patent
Anderson

(10) Patent No.: US 6,302,182 B1
(45) Date of Patent: Oct. 16, 2001

(54) CONTROL DRUM WITH ADJUSTABLE FRICTION

(75) Inventor: Richard N. Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/477,698

(22) Filed: Jan. 6, 2000

Related U.S. Application Data

(60) Provisional application No. 60/115,027, filed on Jan. 7, 1999.

(51) Int. Cl.[7] ..... E06B 9/38
(52) U.S. Cl. ..... 160/177 R
(58) Field of Search ..... 160/177 R, 176.1 R, 160/178.1 R, 168.1 R, 173 R, 405

(56) References Cited

U.S. PATENT DOCUMENTS

| | | | | |
|---|---|---|---|---|
| 2,469,839 | * | 5/1949 | Nelson | 160/177 R |
| 2,589,846 | * | 3/1952 | Nelson | 160/177 R |
| 2,667,220 | * | 1/1954 | Rutledge | 160/177 R |
| 2,670,038 | * | 2/1954 | Lorentzen | 160/177 R |
| 4,623,012 | | 11/1986 | Rude et al. . | |
| 5,228,491 | | 7/1993 | Rude et al. . | |
| 5,341,865 | | 8/1994 | Fraser et al. . | |
| 5,495,153 | | 2/1996 | Domel et al. . | |
| 5,662,154 | | 9/1997 | Drake, III . | |

FOREIGN PATENT DOCUMENTS

| | | |
|---|---|---|
| 76262/91 | 11/1991 | (AU) . |
| 2162443 | 5/1996 | (CA) . |
| 82239134 | 1/1983 | (DE) . |
| 29508479 | 9/1995 | (DE) . |
| 2076454 | 9/1983 | (GB) . |
| 161962 | 2/1972 | (NZ) . |

* cited by examiner

*Primary Examiner*—David M. Purol
(74) *Attorney, Agent, or Firm*—Dorsey & Whitney LLP

(57) ABSTRACT

The present invention provides a control drum, such as a tilt drum for a Venetian blind, with adjustable friction elements (such as spring legs), so that the friction between the control drum and the control shaft (e.g., tilt rod), can be greatly reduced during installation and then can be greatly increased once the drum has been installed on the control shaft. The present invention accordingly permits easy installation without sacrificing the benefits of an interference fit between the control drum and control shaft.

29 Claims, 6 Drawing Sheets

CONTROL DRUM WITH ADJUSTABLE FRICTION

CROSS-REFERENCE TO RELATED APPLICATIONS

Applicants claim priority to U.S. Provisional Application No. 60/115,027, filed Jan. 7, 1999, which is herein incorporated by reference. This application is also related to U.S. patent application Ser. No. 09/481307, which is also incorporated by reference herein.

FIELD OF THE INVENTION

The present invention relates to adjustable coverings for architectural openings, and, in particular, to a control drum for the tilt cords of adjustable window coverings in which the friction between the drum and the control shaft can be selectively manipulated.

BACKGROUND OF THE INVENTION

It is known to use adjustable coverings over architectural openings. Such adjustable coverings include cellular panels, Venetian blinds, and many other systems for controlling the passage of light, vision, or air through the architectural openings. For example, cellular panels and Venetian blinds can be adjusted by retracting or extending them, and Venetian blinds may be further adjusted by tilting the slats comprising part of the blind.

Tilter mechanisms for Venetian blinds have been created in a variety of configurations. One such tilter mechanism is described in U.S. Pat. No. 5,341,865 "Fraser et al.", which is hereby incorporated by reference. As shown therein, a tilter mechanism typically includes a tilt drum (also called a "tilt roll") that is co-axially mounted on an elongated tilt rod and is adapted to receive the forward and rear ladder laces of the Venetian blind. When the tilt rod is rotated, it rotates the drum in unison therewith, which wraps one of the ladder laces and unwraps the other, thereby causing the slats of the Venetian blind to tilt open and closed about longitudinal/horizontal axes. The tilt rod (and drum) can be rotated by a variety of tilters, including by gear mechanisms driven by a remotely controlled motor or by the manual force of the Venetian-blind user. Tilter mechanisms are also employed to effect adjustment of other adjustable coverings for architectural openings.

In a Venetian blind, the tilter, tilt drum, and tilt rod are all generally located within the headrail housing of the blind (along with other mechanisms such as pulleys and locks to facilitate lifting of the blind). Tilt drum supports are also fixedly attached to the headrail housing to support the tilt drums and/or tilt rod along the length of the headrail. The tilt drum supports prevent the tilt rod from sagging due to the weight of the blind and generally prevent axial movement of the tilt drums relative to the headrail housing.

It is desirable that the tilt rod not be permitted to move axially within the headrail housing. If the tilt rod becomes dislodged from the tilter, for example, the blind cannot be tilted. Moreover, if the tilt rod slides axially within the headrail, it can interfere with other mechanisms, such as the lock for the blind's lifting mechanism. To avoid these problems, the tilt rod can be held in place by a tight connection to the tilter; however, providing a tight fit in the tilter has been found to be cumbersome and difficult during assembly of the blind. Accordingly, the tilt rod is often manufactured in polygonal cross-section that can be slid into a mating, but not tight-fitting, connection in the tilter.

The tilt rod is then held laterally in place by tight fitting connection to the tilt drum. A tight fit between the tilt drum and tilt rod prevents the drum from accidentally sliding relative to the tilt rod. Moreover, because the tilt drums are prohibited from moving laterally by fixed tilt drum supports, the tilt rod can be kept in place without requiring a tight connection to the tilter.

Generally, at least one-half pound of force of interference fit is required between the drum and the tilt rod. Due to manufacturing tolerances, however, the interference-fit force of prior art tilt drums on the tilt rod may be as much as four pounds or more. A high interference-fit force can make it frustrating and difficult to assemble the tilt drum onto the tilt rod.

SUMMARY OF THE INVENTION

The present invention provides a control drum, such as a tilt drum for a Venetian blind, with adjustable friction elements (such as spring legs) so that the friction between the control drum and the control shaft (e.g., tilt rod), can be greatly reduced during installation and then can be greatly increased once the drum has been installed on the control shaft. The present invention accordingly permits easy installation without sacrificing the benefits of an interference fit between the control drum and control shaft.

In particular, the apparatus of the present invention includes: a drum body, defining an axial passage adapted to receive the control shaft of an adjustable covering for an architectural opening; at least a first adjustable friction element (such as a spring leg) mounted on the drum body, the first adjustable friction element being moveable from a resting position to a release position; wherein the first adjustable friction element into the axial passage when in the resting position and does not encroach into the axial passage when in the release position.

The control system of the present invention includes a control shaft having an axis of rotation and having an axial length substantially in excess of its diameter; a drum body, slidably mounted on the control shaft and rotatable about the axis of rotation of the control shaft, the drum body including first and second ends and an axial hole being adapted to a receive the control shaft; at least a first adjustable friction element (such as a spring leg) mounted on the drum body, the first adjustable friction element being moveable from an engaged position to a release position; wherein the first adjustable friction element, when in the engaged position, impedes the drum body from sliding relative to the control shaft, and, when in the release position, permits the drum body to slide relative to the control shaft.

The apparatus and system of the present invention can be advantageously used to secure a control shaft in an adjustable covering for an architectural opening. The method of the present invention includes the following steps: inserting a control shaft into one end of an axial hole defined by a drum body; releasing an adjustable friction element (such as a spring leg) mounted on the drum body to permit the control shaft to slide completely through the drum body via the axial hole; sliding the drum body to a desired position on the control shaft; engaging the adjustable friction element to impede further sliding of the drum body relative to the control shaft; fixedly attaching a drum support to a headrail housing; and substantially impeding movement of the drum body relative to the headrail housing except for rotation of the drum body about the axis of rotation of the control shaft.

The present invention is described in greater detail with respect to the following drawings.

DESCRIPTION OF THE PREFERRED EMBODIMENT

The present invention provides a control drum and system for an adjustable covering of an architectural opening. The drum of the present invention can be adjusted to permit easy assembly onto a control shaft but, after assembly, a sufficiently tight fit on the control shaft to inhibit the control shaft from moving relative to the drum and axially within the headrail housing. Although the present invention is described with relation to a tilting mechanism for a Venetian blind, it is not limited to use with a Venetian blind. Rather, it will be recognized by those of skill in the art that the present invention could be used to control a function in any adjustable covering for an architectural opening that can be controlled by wrapping and/or unwrapping a cord via rotation of a control drum. As such, the terms "tilt drum," "tilt rod," and "Venetian blind," are merely exemplary of the control drum, control shaft, and adjustable covering of the present invention.

Figure 1:
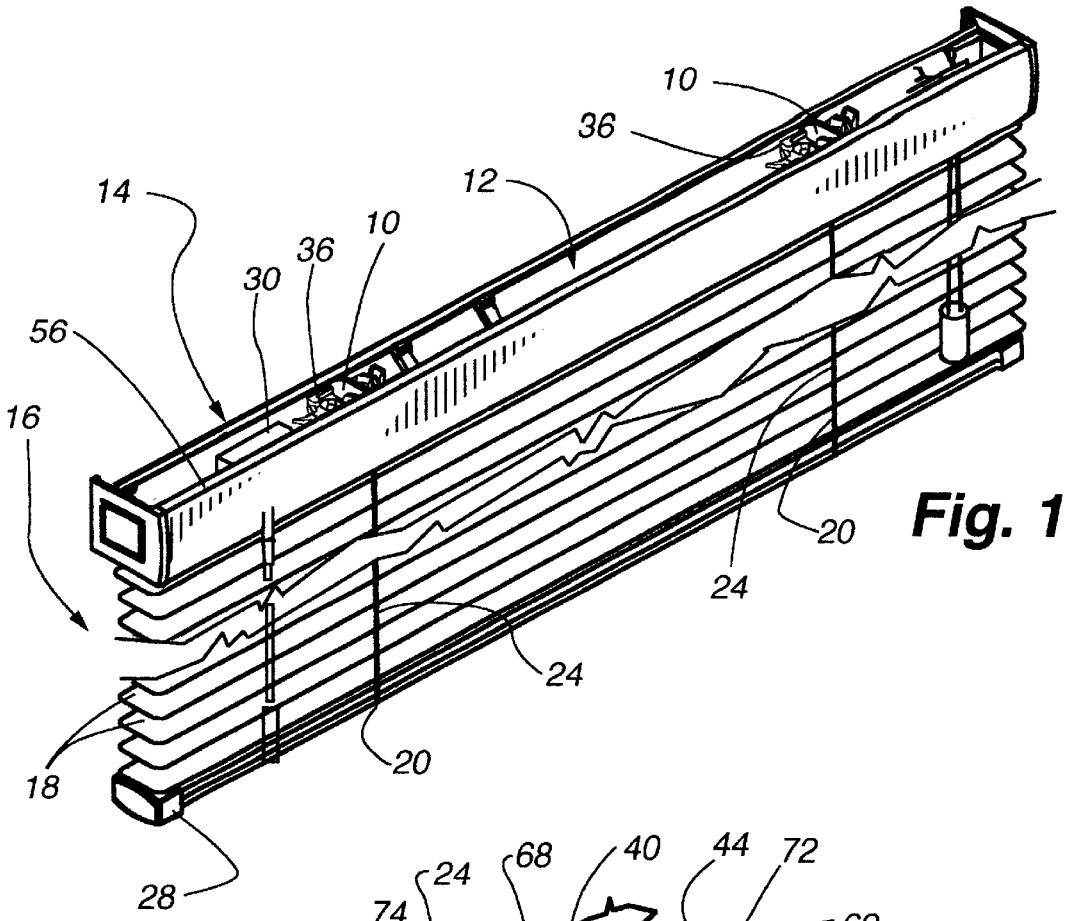
FIG. 1 is a fragmented, isometric view of the top, left, and front of a Venetian blind utilizing the apparatus and system of the present invention.

FIG. 1 shows a Venetian blind 16 constructed according to the present invention. For convenience, several component parts of the present invention are described in directional terms such as "left," "right," "top," and "bottom." It should be understood that these directional terms describe the relative positions of the parts as they are oriented in the Figures and are not limiting of the present invention.

Slats 18 of the Venetian blind 16 are supported by and manipulated by cord ladders 20. Cross-cords 22 in the cord ladders connect front and rear ladder laces 24, 26. In the exemplary embodiment shown in FIG. 1, there are two cord ladders 20, but, depending on the transverse length of the headrail housing 14, more ladders 20 could be employed. The bottom of each ladder 20 is connected to a bottom rail 28. The top of each ladder 20 and particularly each set of front and rear ladder laces 24, 26 is connected to a tilt drum 10 such that when the tilt drum 10 rotates, one of the ladder laces 24, 26 is wrapped onto the tilt drum 10 while the other is unwrapped therefrom. In this way, one end of each cross-cord moves up while the other moves down, thus causing a corresponding tilt about horizontal axes of the slats 18 being supported by the cross-cords 22.

Figure 6:
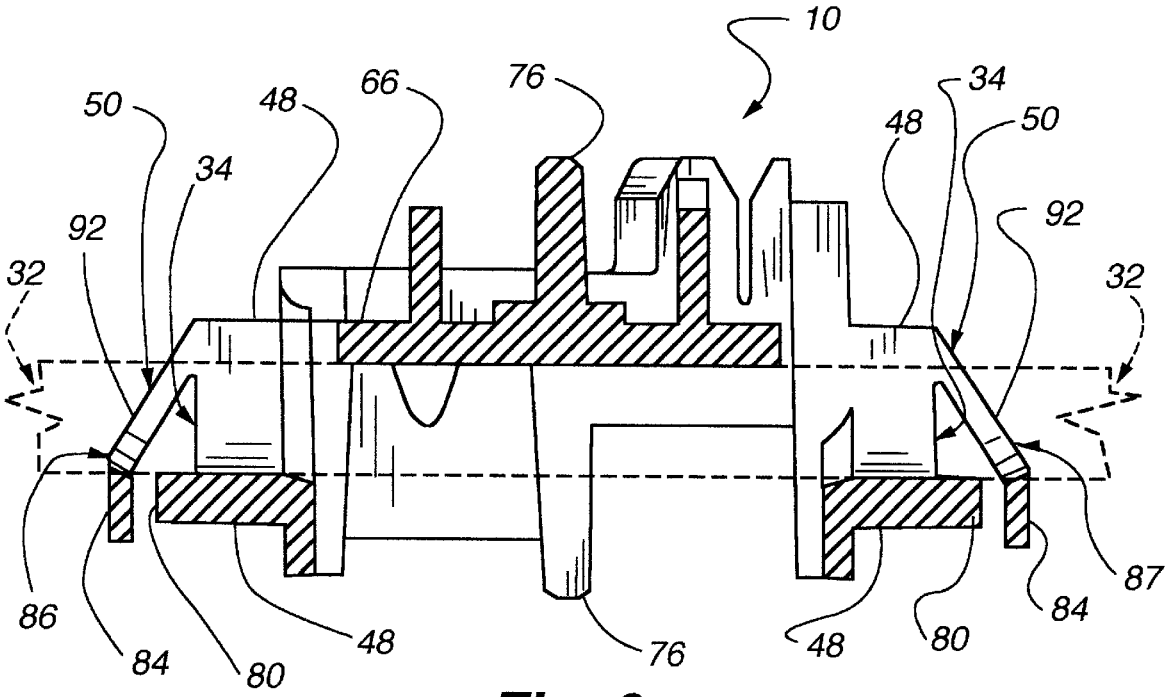
FIG. 6 is a cross-sectional view taken along line 6—6 of FIG. 5.
Figure 7:
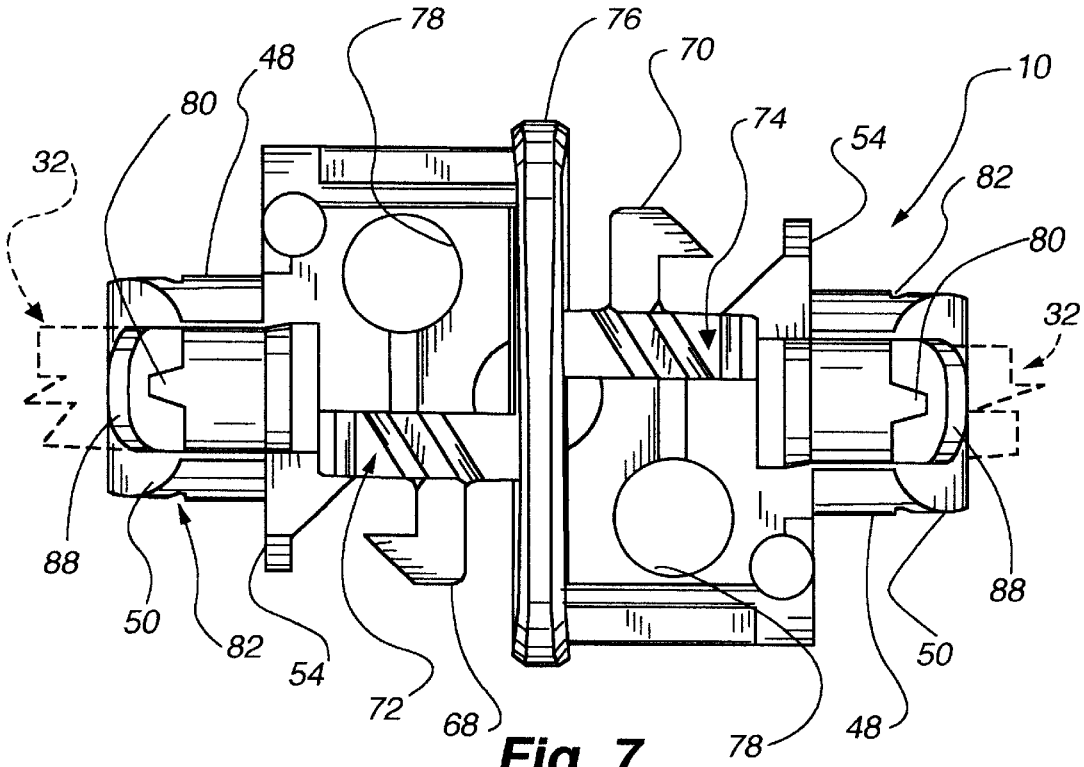
FIG. 7 is a top view of the drum of FIG. 3.
Figure 8:
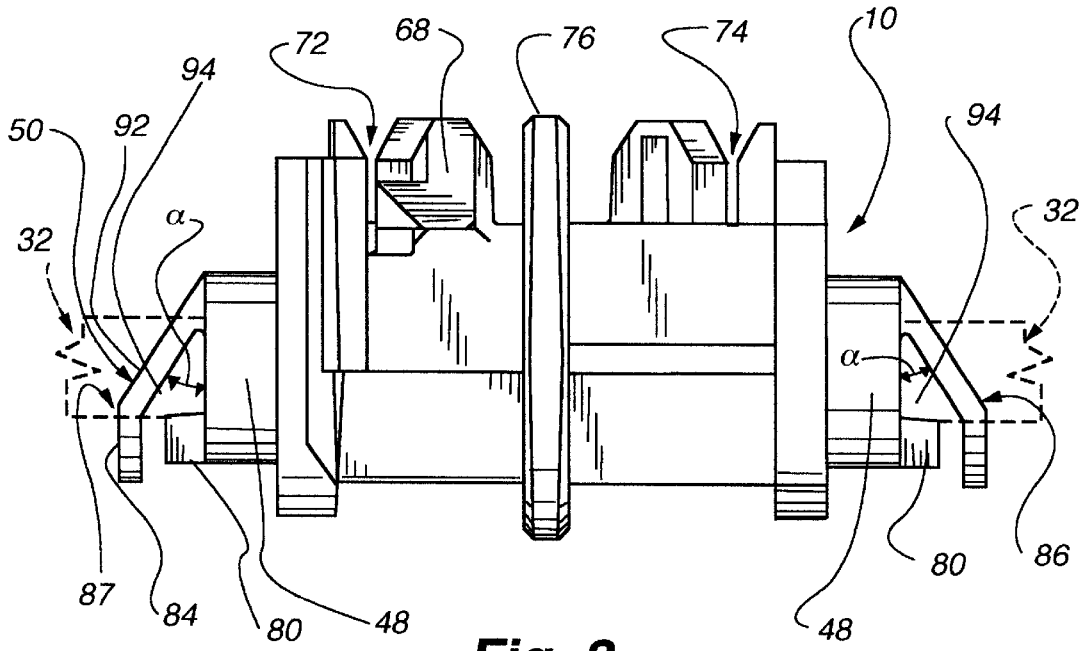
FIG. 8 is a front view of the drum of FIG. 3.
Figure 9:
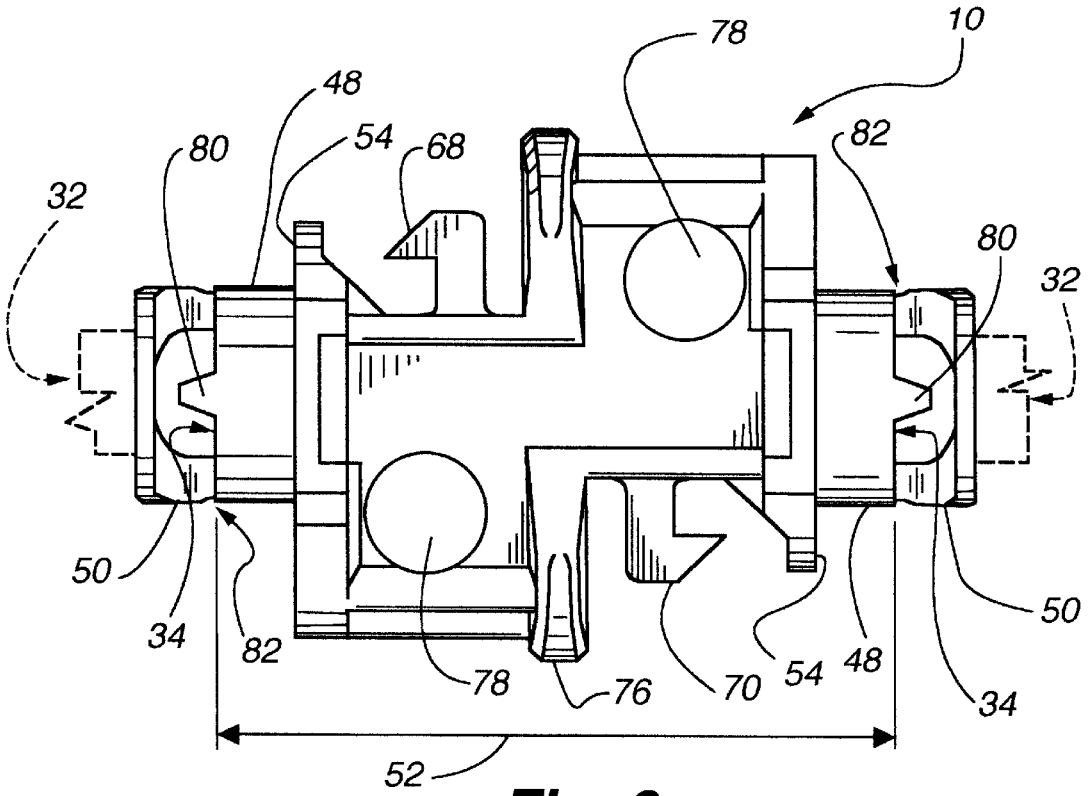
FIG. 9 is a bottom view of the drum of FIG. 3.

The tilt drum 10 is rotated by its connection to a tilt rod 12, which, in turn, is rotatably connected to a tilter 30. The tilt rod 12 extends the majority of the length of the headrail housing 14 and passes through an axial passage 32 defined, in part, by axial holes 34 in the tilt drums 10 (FIGS. 6–8). A variety of tilters 30 can be used to accomplish rotation of the tilt rod 12 (and tilt drums 10), including a worm shaft/pinion combination as described in U.S. Pat. No. 5,341,865, previously incorporated herein by reference. Alternatively, an automated tilter 30 can be employed, such as a remotely controlled motor located within the headrail housing 14 capable of driving the tilt rod 12 to rotate in either direction. A preferred motorized tilting apparatus is described in U.S. patent application Ser. No. 09/481307, previously incorporated by reference.

Figure 2:
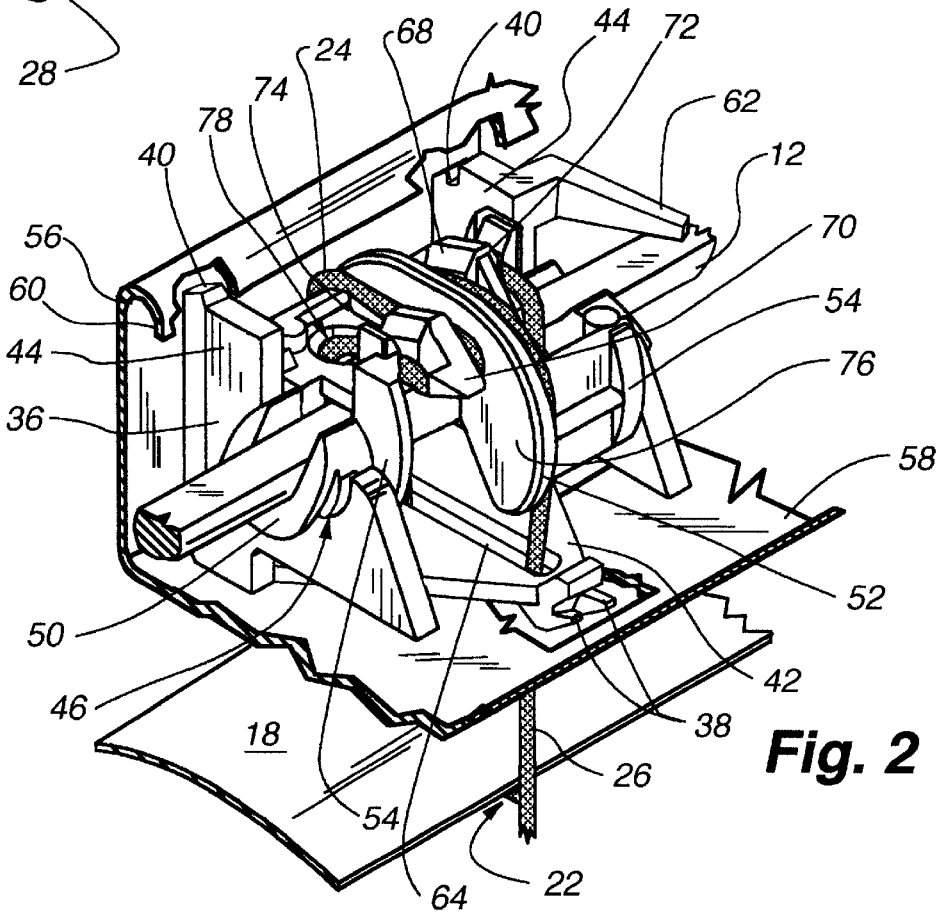
FIG. 2 is a fragmented, broken-away, isometric view of the rear, top, and right of a tilt drum, drum support and other elements of a Venetian blind according to the present invention.
Figure 3:
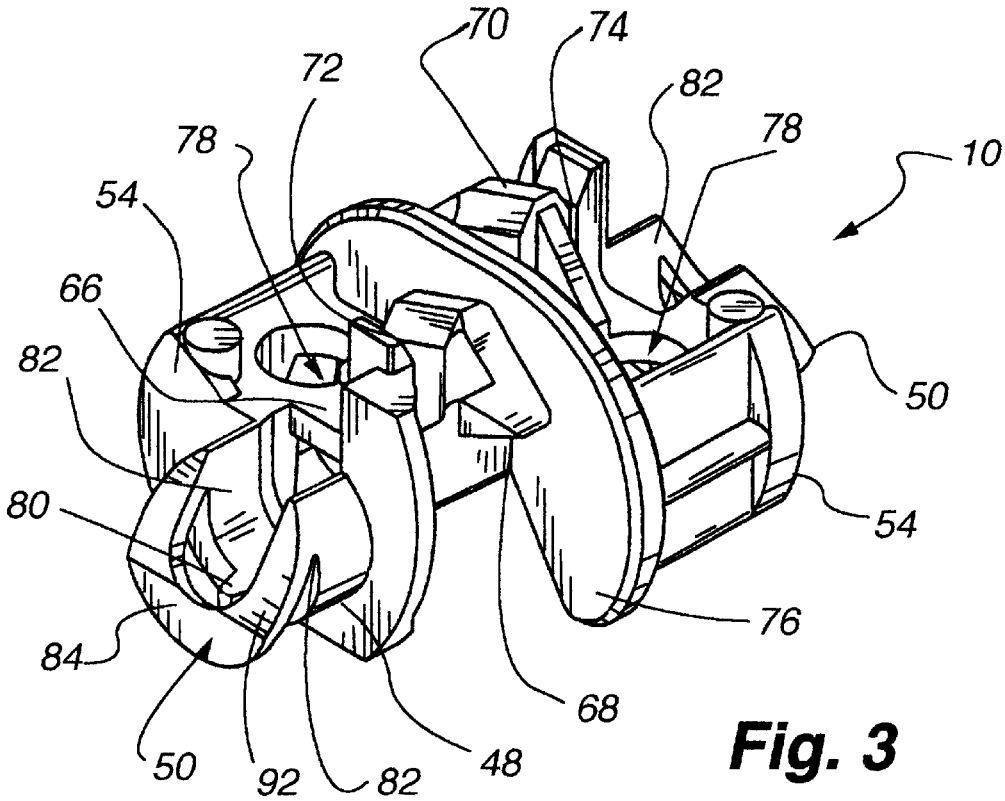
FIG. 3 is an isometric view of the front, top, and left of a tilt drum made in accordance with the present invention.
Figure 4:
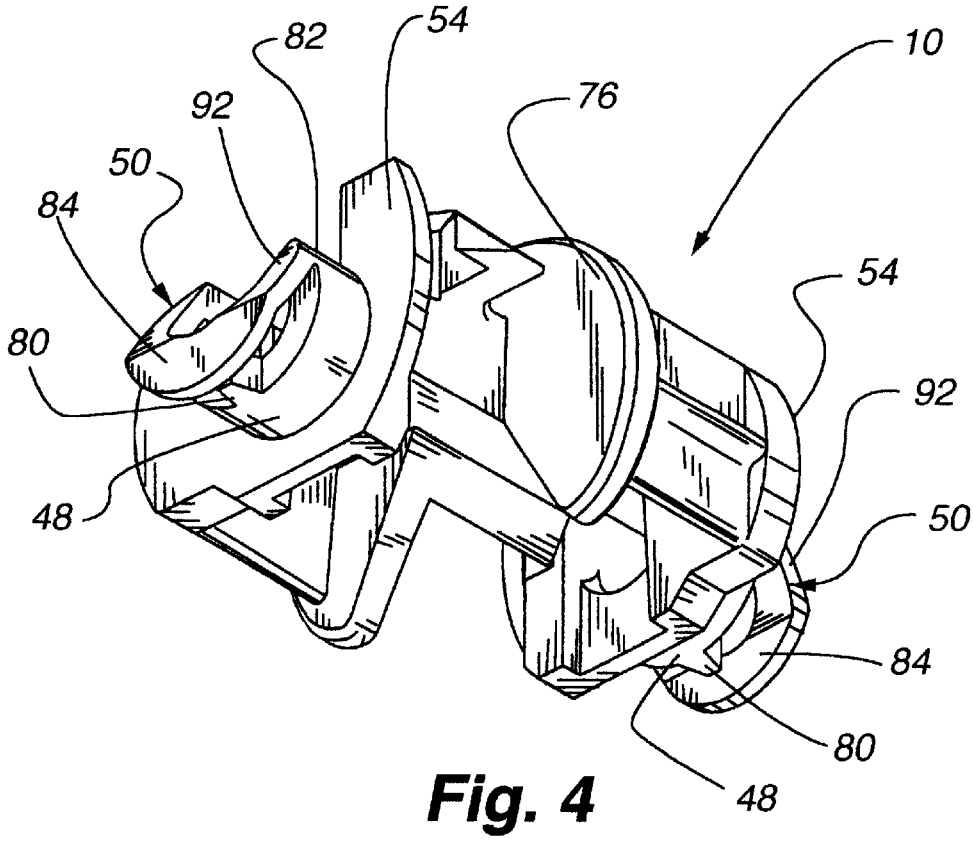
FIG. 4 is an isometric view of the front, bottom, and left of the drum of FIG. 3.
Figure 5:
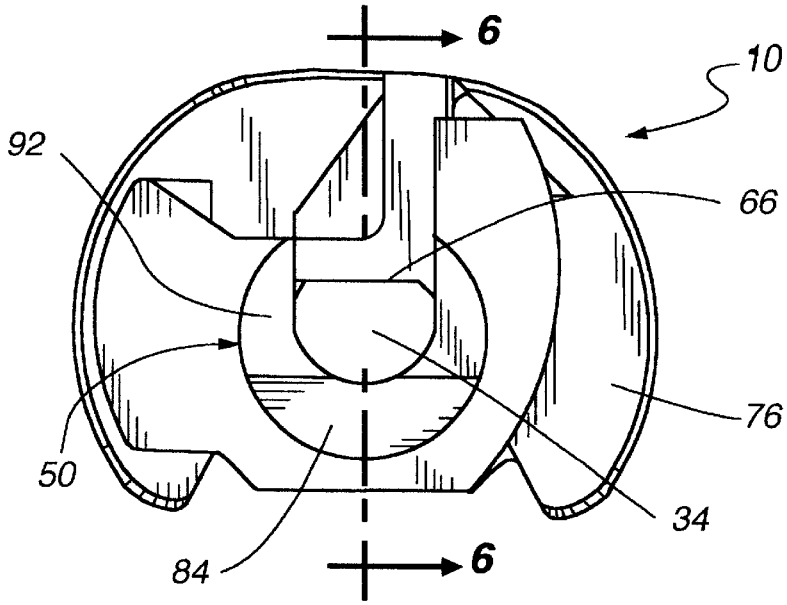
FIG. 5 is a left end view of the drum of FIG. 3.

As seen most easily in FIG. 2, each tilt drum 10 is supported by a tilt drum support 36. The supports 36 are fixedly attached to the headrail housing 14. Preferably, the attachment of the supports 36 to the headrail housing 14 is accomplished by tabs 38, 40 extending from a base 42 and end walls 44 of the support 36 that engage matching openings and grooves in the headrail housing 14. However, any suitable form of attachment can be used, including screws, adhesives, etc.

Each tilt drum support 36 includes end walls 44 having support surfaces 46 that engage bearings 48 on the tilt drum 10. The support surfaces 46 are arcuately shaped to accept the bearings 48 of the tilt drum 10 such that the tilt drum 10 can rotate freely within the support 36. Preferably the support surfaces 46 do not extend axially past the bearings 48 of the tilt drum 10 so as not to interfere with the operation of spring legs 50 provided thereon. The operation of the spring legs 50 is explained below. Preferably, the end walls 44 of the support 36 are spaced to accept a tilt drum body 52 between them in a close-fitting, but not interference-fitting, relationship. In other words, enough space is provided between the end walls 44 of the support 36 and end walls 54 of the tilt drum body 52 to permit the tilt drum body 52 to rotate within the support 36 without being significantly impeded by frictional contact with the end walls 44; however, the end walls 44 of the support 36 are spaced close enough together to prevent any significant lateral movement of the tilt drum body 52 within the support 36.

The end walls 44 of the support 36 are preferably not connected to the base 42 of the support 36 except near the front wall 56 of the headrail housing 14. This disconnection between the end walls 44 and the majority of the base 42 allows the base 42 to flex relative to the end walls 44. This permits the base tabs 38 to be inserted under the bottom wall 58 of the headrail housing 14 first. The base 42 of the support 44 then flexes easily to allow the end-wall tabs 40 to be snapped under a ledge 60 formed by the front wall 56 of the headrail housing 14.

Each tilt drum support 36 further includes an ear 62, which extends from an end wall 44 above one of the support surfaces 46 and above the tilt rod 12. The ear 62 is preferably created at such an angle and height so as not to interfere with the rotation of the tilt drum 10 or of the tilt rod 12. However, the ear 62 is preferably situated to impede the tilt drum 10 from becoming dislodged from the tilt drum support 36. In other words, the distance from the top of the tilt rod 12 to the bottom of the ear 62 should be less than the distance from the bottom of the support surface 46 to the top edge of the support surface 46.

Each tilt drum support 36 also includes an opening 64 on the base 42 thereof that matches an opening (not shown) on the bottom wall 58 of the headrail housing 14 and is adapted to receive the ladder laces 24, 26 for connection to the tilt drum 10. Preferably, the opening 64 is provided across nearly the full length of the base 42 to permit the ladder laces 24, 26 to be spaced as far apart as practically possible when entering the support 36. As explained in U.S. Pat. No. 5,341,865, previously incorporated herein by reference, this spacing helps avoid the problem of the uppermost slat 18 of the blind 16 being "stuck" in its tilted position. The entire support 36 is preferably molded as a single piece from a resin having a high plastic memory.

A preferred embodiment of the tilt drum 10 of the present invention is shown in various views in FIGS. 3–13. The tilt drum body 52 defines, in part, an axial passage 32 adapted to receive the tilt rod 12. As used herein, tilt drum body 52 (FIG. 9) is defined to include the bearings 48 and the portion of the tilt drum 10 between (and including) the end walls 54, but does not include the spring legs 50 (unless the spring legs 50 are mounted within the drum body 52). Further, the axial passage 32 (FIG. 6) is defined as the elongated axial hole 34 between the bearings 48, along with axial extensions thereof in either axial direction (including beyond the ends of the bearings 48). As shown in FIGS. 3–13, the cross-sectional shape of the axial passage 32 and axial hole 34 can be defined by axially spaced parts of the drum body 52. In the exemplary embodiment shown in FIGS. 3–13, the bottom and sides of the axial passage 32 are defined by the U-shaped bearings 48, and the top of the axial passage 32 is defined by the underside of a top drum wall 66. The cross-sectional shape of the axial passage 32 can most easily be seen in FIG. 5, which is a left-side view of the tilt drum 10 with the spring legs 50 in an "engaged position" (the engaged position is explained below). Again, however, as shown by the dotted lines in FIGS. 6–9, the axial passage 32 extends beyond the bearings 48 of the tilt drum 10 in either axial direction. In an alternative embodiment, the axial passage 32 can be defined by a completely enclosed axial hole extending from one bearing 48 to the other (and axial extensions thereof in either direction).

The tilt rod 12 can be of any polygonal cross-sectional shape. The axial hole 34 (i.e., that part of the axial passage 32 located between (and including) the bearings 48 of the tilt drum 10) corresponds closely to the non-circular cross-section of the tilt rod 12. As such, the cross-sectional shape of the axial hole 34 shown in FIGS. 2–13 is merely exemplary. The axial hole 34 need only correspond closely enough to the shape of the tilt rod 12 such that when the tilt rod 12 rotates, the tilt drum 10 rotates with it. As discussed, it is not preferred, according to the present invention, that the axial hole 34 be so small as to create a high interference-force fit with the tilt rod 12. Rather, the cross-section of the axial hole 34 is preferably slightly larger than the cross-section of the tilt rod 12 so that the tilt rod 12 slides easily through the axial hole 34 during mounting of the tilt drum 10 onto the tilt rod 12. The frictional force to keep the tilt drum 10 from unwanted sliding relative to the tilt rod 12 is supplied by the spring legs 50, which will be described further below.

The ladder laces 24, 26 can be connected to the tilt drum 10 by any number of means, including those discussed in U.S. Pat. No. 5,341,865, previously incorporated herein by reference. In the exemplary embodiment shown in FIGS. 2–13, the ladder laces 24, 26 are attached to the tilt drum 10 by left and right hooks 68, 70 and corresponding left and right pinch points 72, 74. As shown most clearly in FIGS. 12 and 13, each ladder lace 24, 26 is threaded between a middle wall 76 on the drum body 52 and one of the hooks 68, 70. The free end of the ladder lace 24, 26 is then forced down into one of the pinch points 72, 74. In this manner, some of the tension in the ladder laces 24, 26 created by the weight of the slats 18 and bottom rail 28 is borne by the hooks 68, 70, decreasing the chance that the ladder laces 24, 26 will be pulled free of the pinch points 72, 74.

Figure 12:
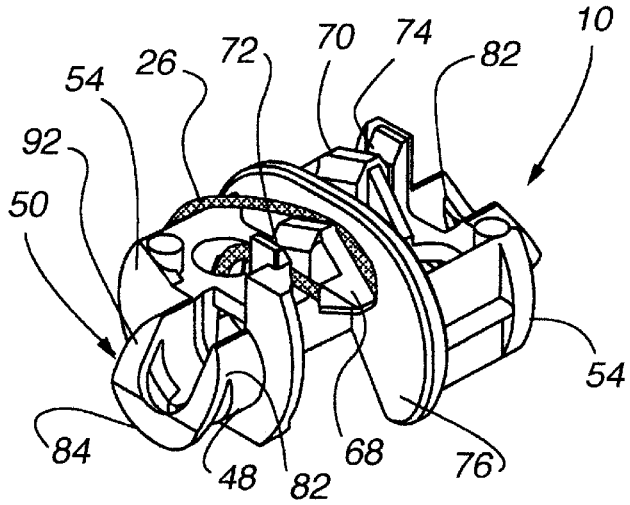
FIG. 12 is an isometric view of the top, front, and left of the drum of FIG. 3 with one of the ladder laces installed on the drum.
Figure 13:
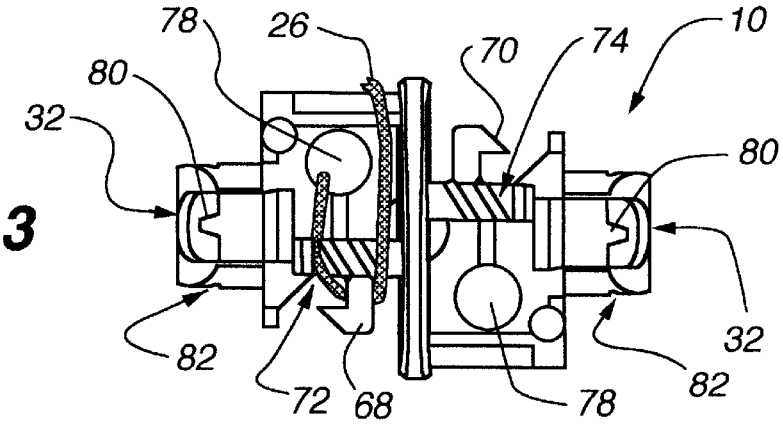
FIG. 13 is a top view of the drum and ladder lace of FIG. 12.

Excess length of the ladder laces 24, 26 is tucked into holes 78 provided in the drum body 52 (FIGS. 2, 12, 13). Notably, the holes 78 are placed so that when the ladder laces 24, 26 are tucked therein, the ladder laces 24, 26 not to interfere with the axial passage 32 (or axial hole 34) through the drum body 52. For simplicity, in FIGS. 12 and 13 only the rear ladder lace 26 is shown as connected to the drum body 52 via the left hook 68 and left pinch point 72. As partially shown in FIG. 2, it will be appreciated that the front ladder lace 24 is connected to the drum body 52 in mirror image via the right hook 70 and right pinch point 74.

Mounted on each of the bearings 48 are spring legs 50 and spring leg stops 80. Each spring leg 50 has a generally U-shape and is mounted to the tilt drum body 52 at hinge points 82 on bearings 48. The hinge points 82 and spring legs 50 are made of a material that has a "memory", i.e. is resilient, in that it tends to return to its original shape. In this preferred embodiment, the entire tilt drum 10, including the drum body 52, the hinge points 82, and the spring legs 50, are molded as a single piece out of a plastic material, preferably a resin with a high plastic memory and relatively high coefficient of friction, such as polycarbonate.

As shown most clearly in FIGS. 6 and 8, when the tilt drum 10 is not mounted on the tilt rod 12, the spring legs 50 are in a resting position and biased into that position due to the resiliency of the material at the hinge points. In this resting position, the lower portion 84 of each spring leg 50 encroaches slightly on the axial passage at points 86, 87. Because the spring legs 50 are flexible at their hinge points 82, however, the lower portion 84 of each spring leg 50 can be pressed down and in towards its respective spring leg stop 80, thereby permitting the tilt rod 12 to occupy the axial passage 32. For example, if the tilt rod 12 is inserted into the left end of the tilt drum 10 (as the drum 10 is oriented in FIG. 8), the frictional force of the tilt rod 12 as it is inserted will naturally cause the left spring leg 50 to be pushed towards its spring leg stop 80, thereby opening up the axial passage 32 on the left side of the tilt drum 10. When the tilt rod 12 is threaded through the axial hole 34 and reaches the right spring leg 50, the right spring leg 50 (which encroaches on the axial passage 32 in its resting position at point 86) will create resistance against the further insertion of the tilt rod 12. By pushing the lower portion 84 of the right spring leg 50 towards its spring leg stop 80, the right spring leg 50 clears the axial passage 32 and allows the tilt rod 12 to be pushed fully through the tilt drum 10.

Figure 10:
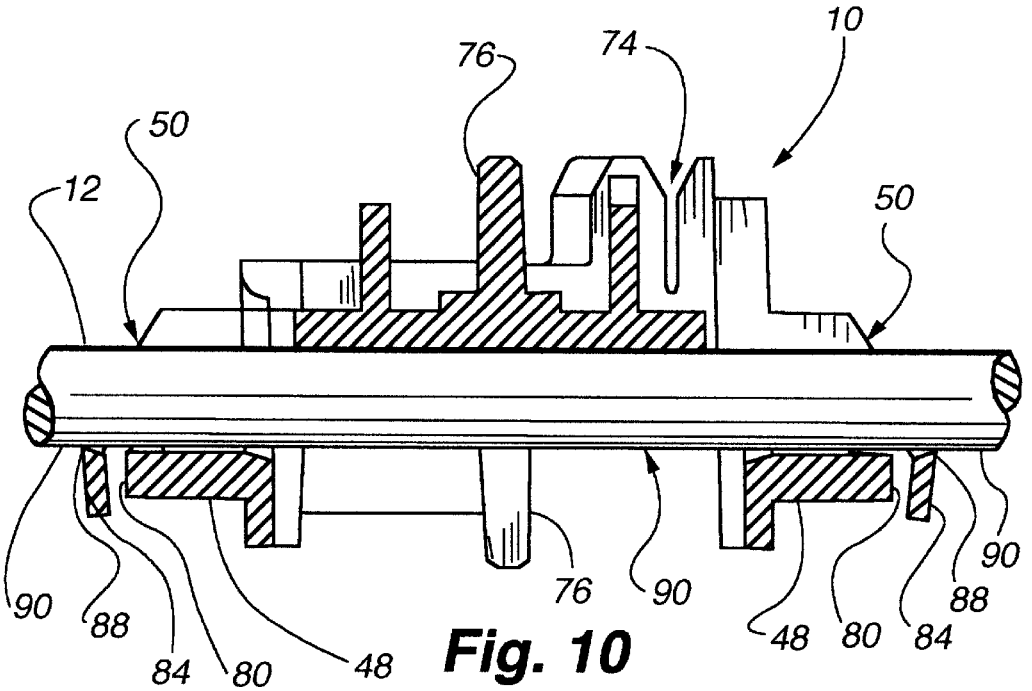
FIG. 10 is the same view as FIG. 6 but showing the tilt rod inserted through the drum.

Once the tilt drum 10 is mounted on the tilt rod 12, as shown most clearly in FIG. 10, the interior surface 88 of each spring leg 50 contacts the bottom surface 90 of the tilt rod 12. This will be referred to herein as the "engaged" position of the spring legs 50. When in the engaged position, the spring legs 50 are slightly displaced from their resting position. Because the spring legs 50 and hinge points 82 are made from a material having memory, the spring legs 50 naturally try to return to their resting positions, thereby exerting an upward force on the tilt rod 12. This creates a substantial friction force between the tilt rod 12 and the tilt drum 10 that prevents the tilt drum 10 from accidentally sliding axially along the tilt rod 12. The amount of friction force between the tilt rod 12 and tilt drum 10 can be adjusted by varying the amount the spring legs 50 encroach into the axial passage 32 when in their resting position and by constructing the spring legs 50 and hinge points 82 from materials having higher or lower resiliency, as desired.

Figure 11:
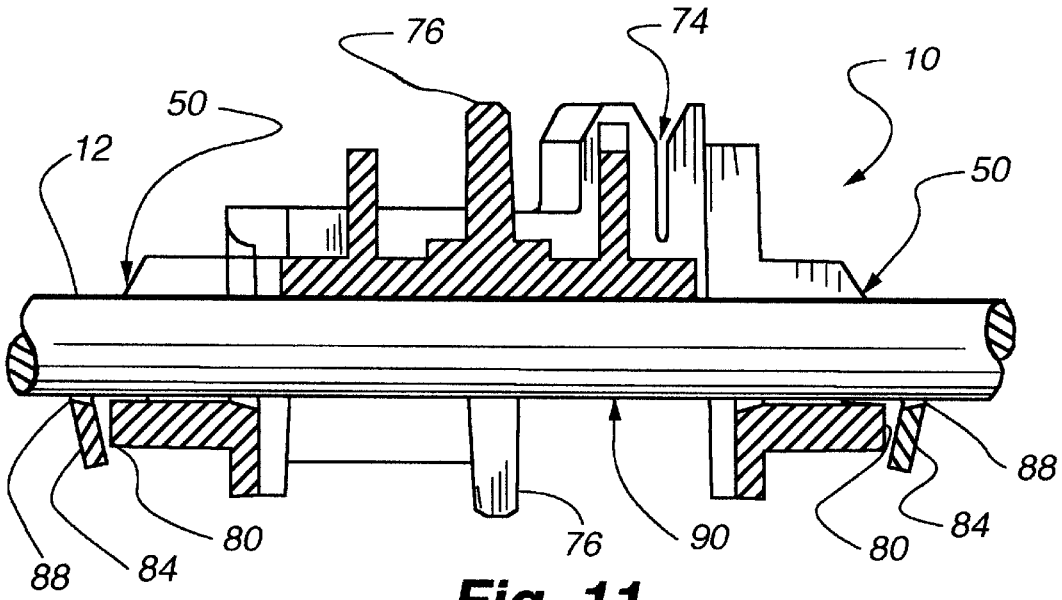
FIG. 11 is the same view as FIG. 10, but showing the spring legs of the drum pressed to a release position.

Once the tilt drum 10 is mounted onto the tilt rod 12, it can be slid to its desired position on the tilt rod 12 by pressing down on one or both of the spring legs 50. In particular, the spring legs 50 can be moved from the engaged position to a "release position" to allow the tilt drum 10 to be slid readily along the tilt rod 12. As shown in FIG. 11, the spring legs 50 can be pressed down and in towards their respective spring leg stops 80 such that the interior surface 88 of each spring leg 50 loses contact with the tilt rod 12. In that position, there is no interference between the spring legs 50 and the tilt rod 12, and the tilt drum 10 can be readily slid along the tilt rod 12 to the desired position. In practice, it is not always necessary to press the spring legs 50 down far enough to separate the spring leg 50 from contact with the tilt rod 12 entirely. Rather, the "release position" may comprise simply pressing hard enough on the spring legs 50 to equalize substantially the upward force exerted by the spring legs 50 in their attempt to return to their resting position. In that instance, the spring legs 50 may still be lightly touching the tilt rod 12 in their release position, but they will not create enough friction to impede significantly the sliding of the tilt drum 10 along the tilt rod 12.

In addition, only one spring leg 50 need be pressed to its release position at a time. It is generally only necessary to release the spring leg 50 opposite the direction in which one desires to slide the tilt drum 10. For example, referring to FIG. 10, if one desired to slide the tilt drum 10 to the left along the tilt rod 12, one need only release the right spring leg 50. The left spring leg 50 automatically tends to release when moved in that direction.

The spring leg stops 80 are preferably molded into the body 52 of the tilt drum 10 on the bearings 48 and prevent the spring legs 50 from being pressed down too far. In addition, in the preferred embodiment shown in the drawings, the lower portion 84 of each of the spring legs 50 is at an angle to the upper portion 92, so that when the spring legs 50 are in a resting position, the lower portion 84 lies substantially perpendicular to the tilt drum's 10 axis of rotation. This makes it easier for someone to push down the spring legs 50 to install the tilt drum 10 on the tilt rod 12.

The front view of the tilt drum 10 shown in FIG. 8 demonstrates that a substantially right triangularly shaped space 94 is formed between the upper portion 92 of each of the spring legs 50 and the end of its respective bearing 48. The uppermost angle a of that triangularly shaped space 94 is at the hinge point 82 and preferably is in the range of 15 to 45 degrees when the spring legs 50 are in their resting position. A right angle is formed between the bearing 48 and the top of the spring leg stop 80. The height of this triangularly shaped space 94 (i.e., the distance from the top of the spring leg stop 80 to the hinge point 82) is approximately the vertical height of the tilt rod 12. The length of the hypotenuse of the triangularly shaped space 94 (the length of the upper portion 92 of the spring leg 50 from the hinge point 82 to the interior surface 88) is substantially greater than the vertical height of the tilt rod 12. The thickness of the material at the hinge point 82 is thin enough to permit flexing and thick enough to prevent breakage during normal use. That thickness will vary depending upon the materials used.

The present invention permits the tilt drum 10 to be manufactured to looser tolerances while still ensuring that the friction between the tilt drum 10 and the tilt rod 12 is low enough to permit easy installation and high enough to prevent the tilt drum 10 from accidentally sliding relative to the tilt rod 12. In addition, because the tilt drums 10 are prohibited by the drum supports 36 from moving laterally within the headrail housing 14, the tilt rod 12 is also impeded from lateral movement without necessitating a tight connection to the titer 30.

It will be apparent to those skilled in the art that modifications may be made to the embodiment described above without departing from the scope of the present invention. For example, the particular position and shape of the spring legs 50 can easily be varied. The spring legs 50 could be reoriented to connect to the bottom of the drum bearing 48 and contact the top of the tilt rod 12 when in the engaged position. Moreover, the spring legs 50 could be attached to the interior of the tilt drum body 52 such that they encroach on the axial hole 34 defined by the tilt drum body 52 rather than just the axial passage 32 beyond the ends of the tilt drum body 52.

Further, it is recognized that the drum support 36 could engage and support the tilt rod 12 directly rather than supporting the tilt drum 10. As discussed, in the preferred embodiment, the drum support 36 provides support surfaces 46 that engage bearings 48 on the tilt drum 10. This arrangement is preferred when used with the tilt drum 10 construction described above. Assume, for example, the drum support 36 engaged the tilt rod 12 directly outside of the preferred tilt drum 10. If the tilt rod 12 (and drum 10) slid to the left within the headrail housing 14, the left spring leg 50 would bump into the end wall 44 of the drum support 36, potentially releasing the left spring leg 50 and allowing the tilt rod 12 to slide relative to the tilt drum 10. However, if the spring legs 50 are moved within the tilt drum body 52 or are configured so as to otherwise alleviate this problem, the drum support 36 can support the tilt rod 12 directly (thereby indirectly supporting the tilt drum 10 by virtue of the drum's mounting on the tilt rod 12). As such, "drum support," as used herein, refers to a support that engages either the tilt drum 10 or the tilt rod 12.

Moreover, it should be understood that separate spring legs 50 are not critical to the present invention and are merely examples of a adjustable friction elements according to the present invention. Rather, the tilt drum body 52 could, itself, be shaped to create adjustable friction when mounted on the tilt rod 12. For example, the axial hole 34 formed by the tilt drum body 52 could be made slightly arcuate (rather than linear as depicted in FIGS. 3–13) by curving the top drum wall 66 such that it is higher at its connection to the middle wall 76 than at its connection to the bearings 48. This would cause the top drum wall 66 to encroach on the axial passage 32 when the tilt drum body 52 was in a resting position (i.e., not mounted on the tilt rod 12). The tilt drum body 52 would then be deformed slightly (by flattening the top drum wall 66) to mount the tilt drum body onto the tilt rod 12. Once mounted on the tilt rod 12 (the "engaged position" in this embodiment), the top drum wall 66 would exert a downward pressure on the tilt rod 12 to create a substantial frictional force between the tilt drum 10 and the tilt rod 12. The tilt drum body 52 could then be "released" from the engaged position by pushing down on middle wall 76, thereby flattening the top drum wall 66 allowing the tilt drum body to slide easily along tilt rod 12. In this embodiment, top drum wall 66 is manufactured of a material having a high plastic memory and is of a thickness to allow it to be flexed but not broken during normal use.

The present invention should thus not be limited except by the following claims.

What is claimed is:

1. A control drum for use on a control shaft of an adjustable covering for an architectural opening, comprising:

a drum body, having first and second ends and defining an axial passage adapted to receive the control shaft of the adjustable covering;

at least a first spring leg mounted on the drum body, resilient hinge means for mounting the first spring leg to the drum body such that the first spring leg is selectively moveable from a resting position to a release position while being biased toward the resting position; and wherein the first spring leg encroaches into the axial passage when in the resting position and does not encroach into the axial passage when in the release position.

2. The control drum of claim 1, further comprising:

a second spring leg mounted on the drum body, the second spring leg being selectively moveable from a resting position to a release position;

wherein the second spring leg encroaches into the axial passage when in the resting position and does not encroach into the axial passage when in the release position.

3. The control drum of claim 1, further comprising:

at least a first connector, attached to the drum body and adapted to receive a first cord for controlling the adjustable covering.

4. The control drum of claim 3, wherein the first connector comprises a hook for wrapping at least a portion of the first cord around and a pinch point for securing the first cord to the drum body.

5. The control drum of claim 1, further comprising bearings mounted on the drum body for cooperating with a drum support to support the drum body and allow the drum body to rotate freely.

6. The control drum of claim 1, wherein the first spring leg is integrally formed with the drum body.

7. The control drum of claim 1, wherein the drum body defines an axial hole between the first and second ends thereof, and the first spring leg encroaches on an axial extension of the axial hole defined by the drum body.

8. The control drum of claim 1, wherein the adjustable covering comprises a Venetian blind, the control shaft comprises a tilt rod, and the control drum comprises a tilt drum.

9. A control system for an adjustable covering for an architectural opening, comprising:

a control shaft having an axis of rotation and having an axial length substantially in excess of its diameter;

a drum body, slidably mounted on the control shaft and rotatable about the axis of rotation of the control shaft, including:

first and second ends; and an axial hole being adapted to a receive the control shaft;

at least a first spring leg mounted on the drum body, resilient hinge means mounting the first spring leg on the drum body such that the first spring leg is selectively moveable from an engaged position to a release position and is biased toward the engaged position;

wherein the first spring leg, when in the engaged position, impedes the drum body from sliding axially relative to the control shaft, and, when in the release position, permits the drum body to slide axially relative to the control shaft.

10. The control system of claim 9, further comprising:

a driver, operatively connected to the control shaft, adapted to rotate the control shaft about its axis of rotation; and at least one cord for controlling the adjustable covering;

wherein the drum body further includes at least one ladder-lace connector and wherein the cord is connected to the drum body by the connector such that when the drum body is rotated, the adjustable covering is adjusted.

11. The control system of claim 9, wherein the first spring leg is mounted on the first end of the drum body and, when in the engaged position, impedes the drum body from sliding in the direction of the second end relative to the control shaft.

12. The control system of claim 9, wherein the first spring leg, when in the engaged position, impedes the drum body from sliding in a first axial direction relative to the control shaft, the drum body further including:

a second spring leg mounted on the drum body, the second spring leg being selectively moveable from an engaged position to a release position, wherein the second spring leg, when in the engaged position, impedes the drum body from sliding in a second axial direction relative to the control shaft, and, when in the release position, permits the drum body to slide in the second direction.

13. The control system of claim 9, further comprising:

a drum support, fixedly attached to the headrail housing, including bearing surfaces allowing the drum body to rotate about the axis of rotation of the control shaft but impeding the drum body from moving axially relative to the headrail housing; and a headrail housing, at least partially enclosing the tilt rod.

14. The control system of claim 9, wherein the first spring leg is integrally formed with the drum body.

15. The control system of claim 9, wherein the first spring leg is mounted on the first end of the drum body.

16. The control system of claim 9, wherein the adjustable covering comprises a Venetian blind, the control shaft comprises a tilt rod, and the drum body comprises a tilt drum body.

17. A method of securing a control shaft in an adjustable covering for an architectural opening, comprising the steps of:

inserting the control shaft having a longitudinal axis of rotation into one end of an axial hole defined by a drum body;

releasing a spring leg resiliently mounted on the drum body with hinge means to permit the control shaft to slide axially completely through the drum body via the axial hole;

axially sliding the drum body to a desired position on the control shaft;

engaging the spring leg to impede further sliding of the drum body relative to the control shaft;

inserting the control shaft and drum body into a headrail housing; whereby the drum body is substantially prevented from axial movement relative to the headrail.

18. The method of claim 17, further comprising the steps of:

inserting one end of the control shaft into a driver capable of rotating the control shaft about the axis of rotation;

attaching at least a first cord to the drum body; and rotating the drum body via the driver and control shaft such that the first cord wraps at least partially around the drum body.

19. The method of claim 17, wherein the step of substantially preventing includes fixedly attaching a drum support to the headrail housing, and the step of inserting the control shaft into the headrail housing includes positioning the drum body within end walls of the drum support.

20. The method of claim 17, wherein the adjustable covering is a Venetian blind.

21. A control drum for use on a control shaft of an adjustable covering for an architectural opening, comprising:

a drum body, having first and second ends and defining an axial passage adapted to receive the control shaft of the adjustable covering;

an adjustable friction element hingedly and resiliently connected to the drum body and being selectively moveable from a resting position to a release position while being biased toward the resting position; and wherein the adjustable friction element encroaches into the axial passage when in the resting position and does not encroach into the axial passage when in the release position.

22. The control drum of claim 21, wherein the adjustable friction element comprises a spring leg.

23. The control drum of claim 21, wherein the adjustable friction element comprises a portion of the drum body.

24. A control system for an adjustable covering for an architectural opening, comprising:

a control shaft having an axis of rotation and having an axial length substantially in excess of its diameter;

a drum body, slidably mounted on the control shaft and rotatable about the axis of rotation of the control shaft, including:

first and second ends; and an axial hole being adapted to a receive the control shaft;

an adjustable friction element hingedly and resiliently mounted on the drum body, the adjustable friction element being selectively moveable from an engaged position to a release position and being biased toward the engaged position;

wherein the adjustable friction element, when in the engaged position, impedes the drum body from sliding axially relative to the control shaft, and, when in the release position, permits the drum body to slide axially relative to the control shaft.

25. The control drum of claim 24, wherein the adjustable friction element comprises a spring leg.

26. The control drum of claim 24, wherein the adjustable friction element comprises a portion of the drum body.

27. A method of securing a control shaft in an adjustable covering for an architectural opening, comprising the steps of:

inserting the control shaft having a longitudinal axis of rotation into one end of an axial hole defined by a drum body;

releasing an adjustable friction element hingedly and resiliently mounted on the drum body to permit the control shaft to slide axially completely through the drum body via the axial hole;

axially sliding the drum body to a desired position on the control shaft;

engaging the adjustable friction element to impede further sliding of the drum body relative to the control shaft;

inserting the control shaft and drum body into a headrail housing; whereby the drum body is substantially prevented from axial movement relative to the headrail.

28. The control drum of claim 27, wherein the adjustable friction element comprises a spring leg.

29. The control drum of claim 28, wherein the adjustable friction element comprises a portion of the drum body.

* * * * *